United States Patent [19]

Abiko et al.

[11] Patent Number: 4,826,025

[45] Date of Patent: May 2, 1989

[54] AMPOULE PACKAGE

[75] Inventors: Kenji Abiko; Yoshio Watanabe; Noboru Anzai, all of Kaminoyma; Kenichi Takahashi, Tokyo, all of Japan

[73] Assignee: Toppan Printing Co., Ltd. & Mect Corp., Japan

[21] Appl. No.: 121,537

[22] Filed: Nov. 17, 1987

[30] Foreign Application Priority Data

Nov. 21, 1986 [JP] Japan ..... 61-278339
Mar. 31, 1987 [JP] Japan ..... 62-47930

[51] Int. Cl.[4] ..... B65D 1/02
[52] U.S. Cl. ..... 215/32 SM
[58] Field of Search ..... 215/32; 604/403

[56] References Cited

U.S. PATENT DOCUMENTS 3,253,619 5/1966 Cook et al. ..... 138/125
3,749,271 7/1973 Ellis, Jr. et al. ..... 215/32

FOREIGN PATENT DOCUMENTS 751167 3/1970 France ..... 215/32

OTHER PUBLICATIONS

*Korvex:Heat Shrinkable Tubing,* Chemplast, Inc., Received 8-18-77 (Copy in Class 174, Digest 8).

*Primary Examiner*—Allen M. Ostrager
*Attorney, Agent, or Firm*—Ostrolenk, Faber, Gerb & Soffen

[57] ABSTRACT

The present invention is connected with an ampoule package in which a stem of an ampoule is wrapped with a heat-shrinkable film, the aforesaid ampoule package being characterized in that at least a constriction of the ampoule is covered with a lower portion of the heat-shrinkable film. According to the ampoule package of the present invention, glass fine pieces of the ampoule neither go into an ampoule nor scatter around it at the time of cutting, and it is unnecessary to care about a wound and injury in cutting the ampoule.

8 Claims, 3 Drawing Sheets

Photomicrograph (X200)

AMPOULE PACKAGE

BACKGROUND OF THE INVENTION

1. Field of the Invention

The present invention relates to an ampoule package, and more specifically to an ampoule package in which consideration is given to prevent the introduction of glass fine pieces into an ampoule and to handle it without any wound and injury.

2. Description of the Prior Art

When an ampoule containing a medicine or the like is used, a shallow hurt is given on a constriction of the ampoule, and a stem of the ampoule is then separated from a body thereof by an applied force. At this time, however, broken or cut glass fine pieces may be formed and get into the ampoule, and when the medicine or the like is drawn up therefrom by a syringe or the like, the glass pieces may be drawn up together and injected into a patient together with the medicine inconveniently. Hence, for the purposes of inhibiting the formation of the glass fine pieces and facilitating the cutting of the ampoule, new ampoules such as one-point ampoules, easy-cut ampoules, tungsten-cut ampoules have been contrived. Although such new ampoules can achieve the easy cutting, the problems regarding the formation of the glass fine pieces and the safety at the time of the cutting remain still. As a next attempt, there has been suggested a method in which an internal pressure in the ampoule is adjusted to be positive when the ampoule containing a liquid is meltingly sealed, whereby the glass pieces can fly off outward in cutting the ampoule. In such a method, however, it is difficult to control the internal pressure, which fact impedes putting it into practice. In addition, since the glass fine pieces scatter around the ampoule which is now being cut, this method also create a hazard.

Moreover, a person may be wounded on the finger, or the person may be careful not to be wounded, so that a working efficiency may deteriorate. In some cases, the person might be infected with bacteria or virus through the wound in a hospital, and he might fall sick. In short, the abovementioned method involves a fatal danger.

On the other hand, another ampoule has been suggested which is shrink-wrapped with a heat-shrinkable film so as to protect the ampoule. However, when such an ampoule is cut, a constriction of the ampoule is exposed, and for the glass pieces formed in cutting, any measure is not taken. Therefore, the person cannot be protected from the danger of the wound in cutting the ampoule, and the glass pieces cannot be prevented from flying about and from getting into the ampoule.

SUMMARY OF THE INVENTION

The present invention intends to overcome the abovementioned drawbacks of the conventional techniques, and thus an object of the present invention is to provide an ampoule package in which glass fine pieces neither go into an ampoule nor scatter around it at the time of cutting and in which it is unnecessary to care about a wound.

That is, the present invention is directed to an ampoule package in which a stem of an ampoule is shrink-wrapped with a heat-shrinkable film, the aforesaid ampoule package being characterized in that at least a constriction of the ampoule is closely covered with a lower portion of the heat-shrinkable film.

DESCRIPTION OF THE PREFERRED EMBODIMENT

An ampoule package of the present invention can be applied to all of ampoules (easy-cut ampoules and tungstencut ampoules) which can be cut in any direction and other ampoules (one-point ampoules) which can be cut in one direction. The heat-shrinkable film which is used herein can be selected from a polyvinyl chloride film, a polypropylene film, a polystyrene film, a polyethylene film and the like, and raw materials for these films can also be chosen from an extensive range. Therefore, a colorless or a colored material can be employed in compliance with a use application.

In particular, if the several colored heat-shrinkable films are suitably used, some kinds of ampoule contents can be distinguished from one other by the colored films wrapped around the respective ampoules. in addition, if there is used the film which has been coated with an ink having light-screening characteristics or colored with a pigment having light-screening characteristics, the contents in the ampoules can be protected from decomposition and quality deterioration. Further, by affixing, to the films, symbols such as an asterisk, an abbreviation, polka dots, straight lines and the like which are distinctive even when deformed, it is also possible to give a distinction to the ampoules.

Now, the present invention will be described in detail as an embodiment in reference to accompanying drawings.

Figure 1:
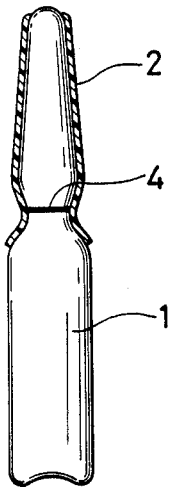
FIG. 1 is a sectional view illustrating one embodiment of an ampoule package regarding the present invention.
Figure 2:
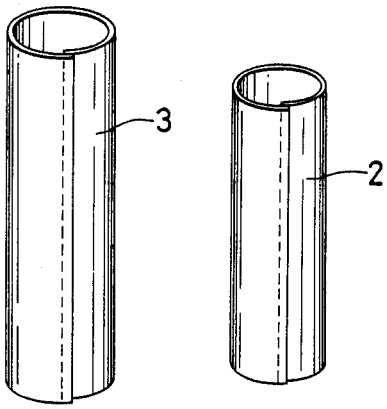
FIG. 2 is a perspective view of heat-shrinkable films used in the present invention.

FIG. 2 is a perspective view showing heat-shrinkable films used in the present invention, and these films include a heat-shrinkable film 3 for wrapping a body of an ampoule and another heat-shrinkable film 2 for wrapping a stem, of the ampoule, having a smaller diameter. Each cylindrical film shown in FIG. 2 is formed by sticking the opposite edges of one film sheet on each other, but another type film, for example, a tube-like film which has been previously formed may be used. FIG. 1 is a sectional view illustrating one exemplary ampoule package of the present invention, and the stem of the ampoule 1 is shrink-wrapped with a heat-shrinkable film 2 for stem wrapping so that a constriction 4 of the ampoule may be covered with the lower portion of the heat-shrinkable film 2.

Figure 3:
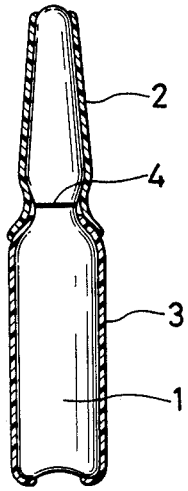
FIGS. 3 to 5 are sectional views illustrating other embodiments of the ampoule packages according to the present invention.
Figure 4:
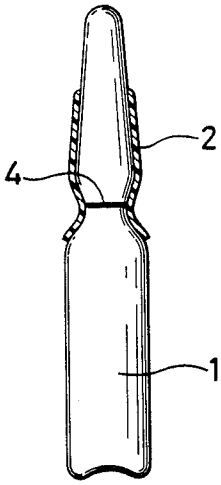
Figure 5:
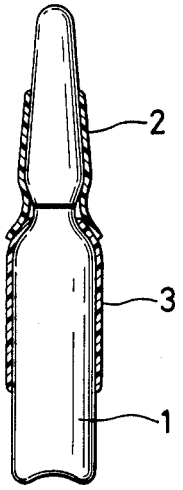

Examples of shrink-wrapping morphologies include a structure of FIG. 1, another structure of FIG. 3 in which the body of the ampoule is wrapped with a heat-shrinkable film 3 for body wrapping prior to wrapping the stem, and other structures of FIGS. 4 and 5 in which upper portions of the film members are cut off to expose the upper portions of the stems. It should be noted that in every structure, the construction of the ampoule is covered with the lower portion of the heat-shrinkable film for stem wrapping. Furthermore, the shrink-rapped film conforms along its entire length to the exterior of the ampoule.

The top portion of the ampoule may be exposed as shown in FIGS. 1, 3 to 5 but may be covered with the heat-shrinkable film having a shape which conforms to that of the top portion. for example, when it is intended to heighten a working efficiency, shrink wrapping may be made by the use of the slightly large film, and the spare film on the top portion of the ampoule may be crushed into a flat shape, followed by cutting off the flat top spare film therefrom in the form of a curve.

Incidentally, a length of the lower portion of the heat-shrinkable film, i.e., a length of the film of from the constriction to the bottom of the ampoule is preferably within the range of 2 to 4 mm from the viewpoints of a removal effect of the glass pieces and a working efficiency.

Figure 6:
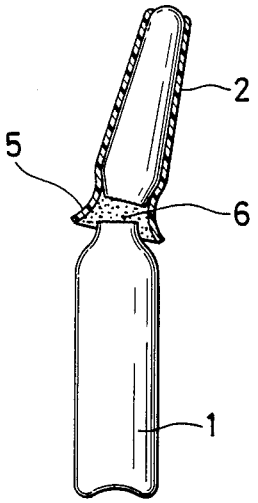
FIG. 6 is a sectional view illustrating the state when the ampoule has been cut.
Figure 7:
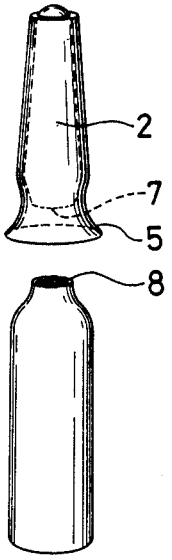
FIG. 7 is a perspective view illustrating the state after the ampoule has been cut.
Figure 8:
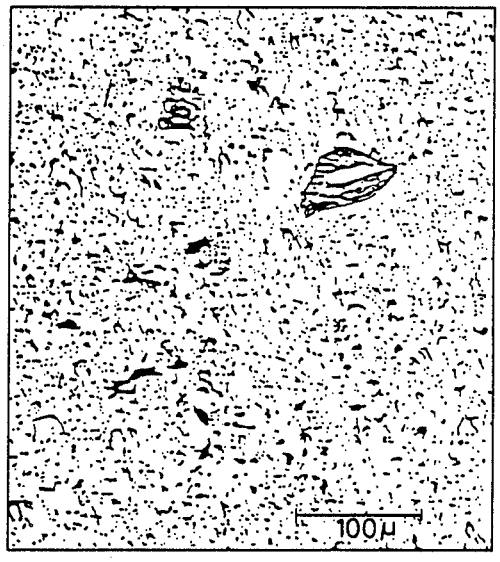
FIG. 8 is an enlarged view illustrating glass fine pieces which adhere to the inside surface of the umbrellalike heat-shrinkable film.

FIG. 6 is a sectional view illustrating the state when the ampoule has been cut, and the formed glass pieces 6 adhere to an umbrella-like lower portion 5 of the heat-shrinkable film 2 for stem wrapping with the aid of static electricity, whereby the glass fine pieces which get into the ampoule and scatter around the ampoule are decreased remarkably. Further, as shown in FIG. 7, a cut surface 7 in the constriction of the ampoule is concealed in the heat-shrinkable film 2 for stem wrapping, and in addition, since immediately after the cutting, the umbrella-like portion of the film is brought into contact with a cut surface 8 of the body of the ampoule, any fingers of a person do not contact with the cut surfaces of the stem and the body of the ampoule and therefore there is no care of a wound.

A questionnaire on the occurrence of the wound was made, and the following results were obtained:

In 59 hospitals, 1262 nurses were examined. As a result, the number of the nurses which were wounded for 6 months by unwrapped ampoules was 638 (50.55%), whereas none of them had any wound, when the ampoules of the present invention were used. In consequence, the number of the nurses which appreciated the wound prevention effect of the present invention was 1110 (87.96%). In other words, the excellence of the ampoules according to the present invention was admitted by most of the nurses.

Furthermore, the ampoules of the present invention were also evaluated to be excellent in easiness of provision and handling.

In order to take precautions against the infection of, for example, a disease of AIDS virus for which any therapy has not been established yet, it is necessary to take care of all infectious factors. Also in this sense, the ampoules of the present invention which have the high wound prevention effect are highly useful.

Next, for the purpose of clarifying the prevention effect of a glass fine pieces introduction into the ampoule by the ampoule package of the present invention, same kinds of ampoules which have been packed with the same liquid under the same conditions are first prepared, and one of the thus prepared ampoules is shrink-wrapped with the heat-shrinkable film and another thereof is not wrapped. Then, both the ampoules are cut under the same conditions, and amounts of the glass fine pieces introduced into the respective ampoules are measured and a difference between these amounts is then sought.

That is, tungsten-cut ampoules were first packed with distilled water for injection and were meltingly sealed, and one group of the ampoules was then shrink-wrapped with a heat-shrinkable film, so that the shrink-wrapped ampoules and the unwrapped ampoules, i.e., the conventional ampoules were prepared. Each ampoule was cut in a clean bench, and then the number of the glass fine pieces in the ampoule was counted by the use of an automatic liquid type particle counter (Rion Co., Ltd.; KL 01 disposed in the clean bench.

Figure 9:
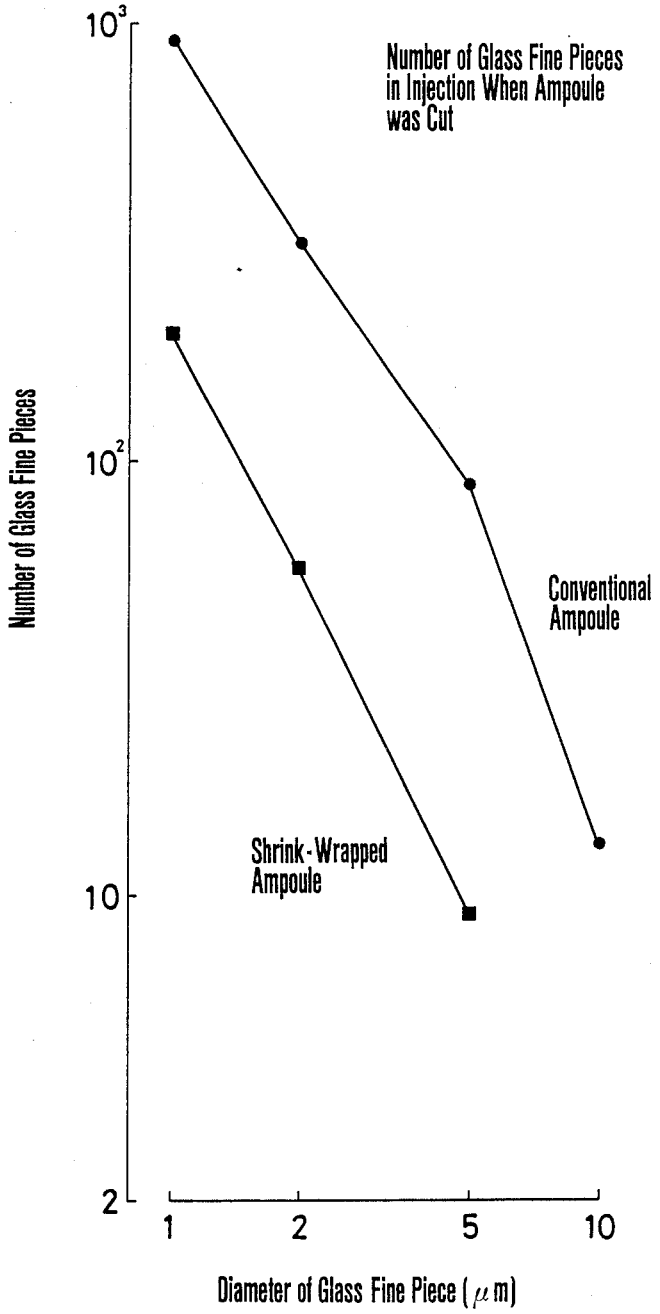
FIG. 9 is a graph showing the prevention effect of a glass fine piece introduction into the ampoule on the basis of experimental results.

The measured results are set forth in Table 1 and in FIG. 9.

In this case, the number of the glass fine pieces is per 5 ml ampoule and is an average value of the 20 ampoules.

TABLE 1

| Specimen | Number of Specimens | Number of Glass Fine Pieces Diameter of Piece (μm) 1–2 | 2–5 | 5–10 | 10–20 | 20< |
|---|---|---|---|---|---|---|
| Conventional Ampoule | 20 | 901 | 317 | 88 | 13 | 0 |
| Shrink-Wrapped Ampoule | 20 | 198 | 57 | 9 | 0 | 0 |

As described above, the ampoule package of the present invention is constituted so that the umbrella-like lower portion of the heat-shrinkable film 2 for stem wrapping may extend below the ampoule stem to cover at least the constriction of the ampoule therewith. Therefore, the glass fine pieces formed cutting the ampoule adhere to the inside surface of the umbrella-like heat-shrinkable film 2 for stem wrapping with the aid of static electricity which takes place on the heat-shrinkable film, whereby the fine pieces are prevented from flying about. In consequence, the fine pieces which get into the ampoule and which fly about are decreased remarkably.

The above-mentioned static electricity can be caused by a difference of electrification properties between the glass and a synthetic resin. In FIG. 6, the umbrella-like portion 5 of the film is electrified to (−), and to this portion, the glass fine pieces 6 electrified to (+) adhere.

SERIES OF ELECTRIFICATION

| (+) | (+) | (+) | (+) |
|---|---|---|---|
| | | Asbestos | |
| | | Human hair | |
| | | Hair skin | |
| | | Glass | |
| | | Mica | |
| | Wool | | |
| | Nylon | | |
| | Rayon | | |
| Lead | | | |
| | Silk | | |
| | Cotton thread | Cotton | |
| | Hemp | | |
| | | Wood | |
| | | Human skin | |
| | Glass fiber | | |
| Zinc | Acetate | | |
| Aluminum | | | |
| | | Paper | |
| Chromium | | | |

-continued

| SERIES OF ELECTRIFICATION | | | |
|---|---|---|---|
| (+) | (+) | (+) | (+) |
| | | | Ebonite |
| Iron | | | |
| Copper | | | |
| Nickel | | | |
| Gold | | Rubber | Polystyrene |
| | Vinylon | | |
| Platinum | | | Polypropylene |
| | Polyester | | |
| | Acrylic resin | | |
| | | | Polyethylene |
| | Polyvinyl-idene chloride | Celluloid | |
| | | Cellophane | |
| | | | Vinyl chloride |
| | | | Polytetrafluo-roethylene (−) |

According to the present invention, the following functional effects can be obtained:

(1) When the ampoule is cut, the glass fine pieces adhere to the inside surface of the extended umbrella-like portion of the heat-shrinkable film for stem wrapping with the aid of the static electricity which occurs at the time of the cutting. Therefore, the prevention effect of the piece introduction into the ampoule is great. Further, the scatter of the glass fine pieces can also be prevented, which fact is preferable from the viewpoint of environmental health.

(2) When the ampoule is cut, any fingers of a person are not wounded, and the deterioration in working efficiency, which is attributable to being careful not to be wounded, can be prevented. Furthermore, doctors and nurses are protected from the infection with bacteria or virus through a wound in a hospital.

(3) When the body of the ampoule is also shrink-wrapped with the heat-shrinkable film, the breakage of the ampoules during handling them is decreased, since each is ampoule is entirely wrapped with the heat-shrinkable film. In addition, the ampoule liquids can be indicated on the outside surface or the inside surface of the heat-shrinkable film, which fact is preferable in point of administration.

What is claimed is:

1. An ampoule package, comprising:

an ampoule having a body, a stem attached to said body, and a constriction between said stem and said body at which said stem is separable from but integrally attached to said body; at and adjacent said constriction, said ampoule narrows in cross-section;

a heat-shrinkable film which is shrink-wrapped around said constriction and around at least a portion of said stem and around the area of said body and of said stem that is adjacent said constriction for said film to be generally conformed to said ampoule where said film is shrink-wrapped around said ampoule.

2. The ampoule package of claim 1, wherein said ampoule and said film are of different respective materials selected such that when said stem is separated from said body by breaking the attachment therebetween at said constriction, broken and cut pieces of said ampoule might normally adhere to said film by static electricity.

3. The ampoule package of claim 1, further comprising a second heat-shrinkable film which is shrink-wrapped around said body but which does not cover said constriction, said second heat-shrinkable film being shrink-wrapped around said body before the first mentioned heat-shrinkable film is shrink-wrapped around said stem and said constriction.

4. The ampoule package of claim 1, wherein said heat-shrinkable film contacts said constriction.

5. The ampoule package of claim 1, wherein said heat-shrinkable film conforms along the entire length of said film to the exterior of said ampoule.

6. The ampoule package of claim 1, wherein said stem has an upper portion away from said constriction and said heat-shrinkable film extends up said stem to below said upper portion of said stem.

7. The ampoule package of claim 1, wherein said ampoule is comprised of glass while said film is comprised of a different heat-shrinkable material.

8. The ampoule package of claim 2, wherein said ampoule is comprised of glass while said film is comprised of a different heat-shrinkable material.

* * * * *